US006545206B2

(12) United States Patent
Brady

(10) Patent No.: US 6,545,206 B2
(45) Date of Patent: Apr. 8, 2003

(54) TOOL FOR MUSICAL INSTRUMENT

(75) Inventor: John W. Brady, Dundee (GB)

(73) Assignee: Dunlop Manufacturing, Inc., Benicia, CA (US)

( * ) Notice: Subject to any disclaimer, the term of this patent is extended or adjusted under 35 U.S.C. 154(b) by 0 days.

(21) Appl. No.: 10/044,465

(22) Filed: Jan. 10, 2002

(65) Prior Publication Data

US 2002/0092409 A1 Jul. 18, 2002

(30) Foreign Application Priority Data

Jan. 12, 2001 (GB) ..... 0100875

(51) Int. Cl.[7] ..... G10G 7/00
(52) U.S. Cl. ..... 84/458
(58) Field of Search ..... 84/458, 460, 297 R, 84/200, 201, 202

(56) References Cited

U.S. PATENT DOCUMENTS

| | | | | | |
|---|---|---|---|---|---|
| 455,822 | A | * | 7/1891 | Weber | 7/127 |
| 3,689,977 | A | * | 9/1972 | Crabbe | 29/253 |
| 3,706,254 | A | | 12/1972 | Morin | |
| D421,882 | S | * | 3/2000 | Mattei | D8/29 |

* cited by examiner

*Primary Examiner*—Shih-Yung Hsieh

(57) ABSTRACT

A guitar bridge-pin removal tool has a solid body sized to fit in a users hand and opposite surfaces that can be gripped between the thumb and fingers. A channel is disposed across one end of the solid body. Such channel has a main cross section that approximates that of a head of a bridge pin that retains a string in a guitar. A necked outer edge runs along the longitudinal lips of the channel and captures the head of said bridge pin along any portion. At least one side end in the channel is open to allow the head of the bridge pins to be slipped in and out.

5 Claims, 3 Drawing Sheets

Fig. 1 *PRIOR ART*
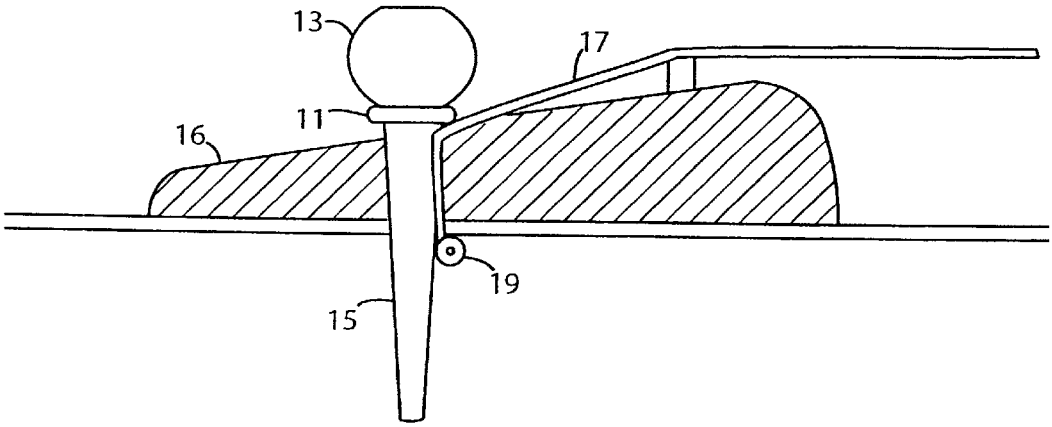

TOOL FOR MUSICAL INSTRUMENT

BACKGROUND OF THE INVENTION

1. Field of the Invention

The present invention relates to tools for musical instrument care, and more particularly to devices for removing the string-retaining pins used in stringed instruments.

2. Description of Related Art

Stringed instruments, like guitars, are usually fitted with several parallel strings that run along a fingerboard between a bridge and corresponding tuning pegs. The strings are usually knotted at one end and passed through a small retaining hole or clip at the bridge end and then turned around the tuning pegs at the distal end. Ordinary nylon and gut strings can be easily knotted and tied in order to secure them to the bridge.

However, wound metal strings are not so easily tied and knotted, and are conventionally secured by a plurality of bridge pins, e.g., as in FIG. 1. Each bridge pin 11 comprises a bulbous head 13, and a tapered stem 15 which is forced into a hole in a bridge base 16. The tapered stem is provided with a groove (not shown) for receiving the string 17, and a ball-shaped or annular element 19 anchors the string 17, preventing the string from moving out of the hole.

In order to maintain high tension in the string, the bridge pin must be forced into the hole. Once this is done, the pins are not easily removed without the aid of a tool. Often, some kind of prying tool, for example a screwdriver, is used to remove the pin from the bridge base. However, great care must be taken when removing the bridge pin from the body of the instrument, as it is easy to cause the tool to slip against the smooth surface of the pin or bridge base. This may cause injury, or damage to the body of the instrument or bridge base.

Alternatively, some kind of gripping tool, for example pliers, may be employed for the removal of the bridge pins. However, these tools may still cause damage to the instrument body or pin head if excessive force is used. Furthermore, pliers are generally made of metal, and are therefore heavy and expensive to manufacture.

U.S. Pat. No. 3,706,254 discloses a tool for cranking the tuning pegs of a guitar which is adapted so that it may also be used for the removal of bridge pins. While this tool is less likely to damage the surface of the guitar, it can be awkward to use, as its primary purpose is not for the removal of bridge pins. In addition, the tool is bigger and more expensive to produce than a bridge pin removal tool needs to be. Further, the tool of the prior art is not suitable for use on all types of bridge bases. Some bridge bases have a protruding ridge running behind and parallel to the row of bridge pins. Such ridge prevents the end wall of the prior art tool from resting against the surface of the bridge base, thus preventing access to the heads of the bridge pins.

It would therefore be desirable to provide a tool for the removal of bridge pins that is simple in structure and is easy to use, without causing damage to the instrument.

SUMMARY OF THE INVENTION

It is the aim of the invention to provide a tool that mitigates one or more of the problems with the prior art.

The invention relates primarily to the removal of bridge pins from guitars, although it is not limited to guitars. The tool may be used on any instrument that uses bridge pins to retain the strings.

According to an aspect of the invention, there is provided a tool for the removal of bridge pins in a string instrument, said tool comprising a body having an operative end face, said end face including a concave recessed channel extending at least partially along the length of the end face, wherein the cross-sectional profile of the recessed channel corresponds to a cross-sectional profile of a head portion of the bridge pin.

Preferably, the body of the tool comprises four long faces and two short end faces, one of said short faces defining the operative end face.

The outer surface of the side walls which define the recessed channel may be shaped to provide a curved profile.

Preferably, the head portion of the bridge pin is substantially spherical, and the cross-sectional profile of the recessed channel is substantially horseshoe-shaped.

The recessed channel preferably extends along the entire length of the operative face.

The tool may be manufactured from wood, metal, or plastic. Preferably, the tool is manufactured from a plastic. The plastic may be polypropylene.

Preferably, the tool is formed by an injection molding process.

The tool may be provided with a string cleaning pad on a face other than the operative end face.

The tool may be provided with a tuning device, said tuning device emitting an audible frequency. Preferably, the tuning device comprises an electronic circuit which includes a battery, a switch, a signal emitter and a loudspeaker. The circuitry may be accommodated in a hollowed-out portion of the tool body.

One of the non-operative faces may be provided with a ring attachment 34. This may be partially embedded into the surface for providing means for attaching a chain and/or clip. The ring 34 provides for a means to carry or secure the whole for future use, e.g., on a keyring, strap, or belt.

The above and still further objects, features, and advantages of the present invention will become apparent upon consideration of the following detailed description of specific embodiments thereof, especially when taken in conjunction with the accompanying drawings.

BRIEF DESCRIPTION OF THE DRAWINGS

FIG. 1 is a cross-section view of a guitar bridge pin construction, as is conventional in the art;

DETAILED DESCRIPTION OF THE INVENTION

Figure 2A:
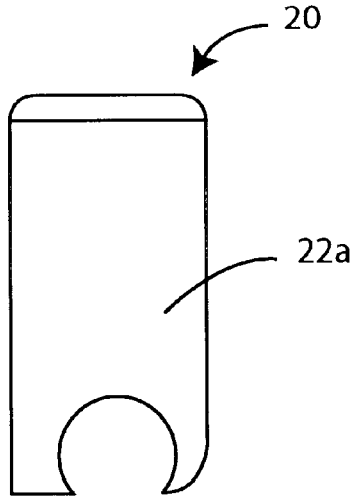
FIG. 2*a* is a side view of a tool according to the invention.
Figure 2B:
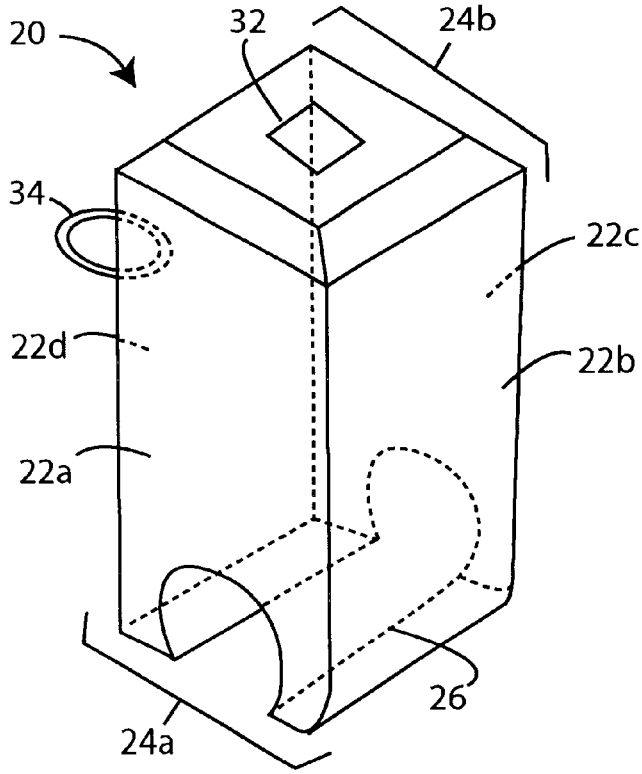
FIG. 2*b* is a perspective view of a tool according to the invention.

FIGS. 2*a* and 2*b* respectively show side and perspective views of the tool according to the invention. In this embodiment, the tool, generally indicated 20, comprises a body that is substantially rectangular, having four long side faces 22*a*, 22*b*, 22*c*, 22*d*, and two end faces 24*a*, 24*b*. Face 24*a* defines the operative end of the tool, and is provided with a recessed channel 26.

Figure 3:
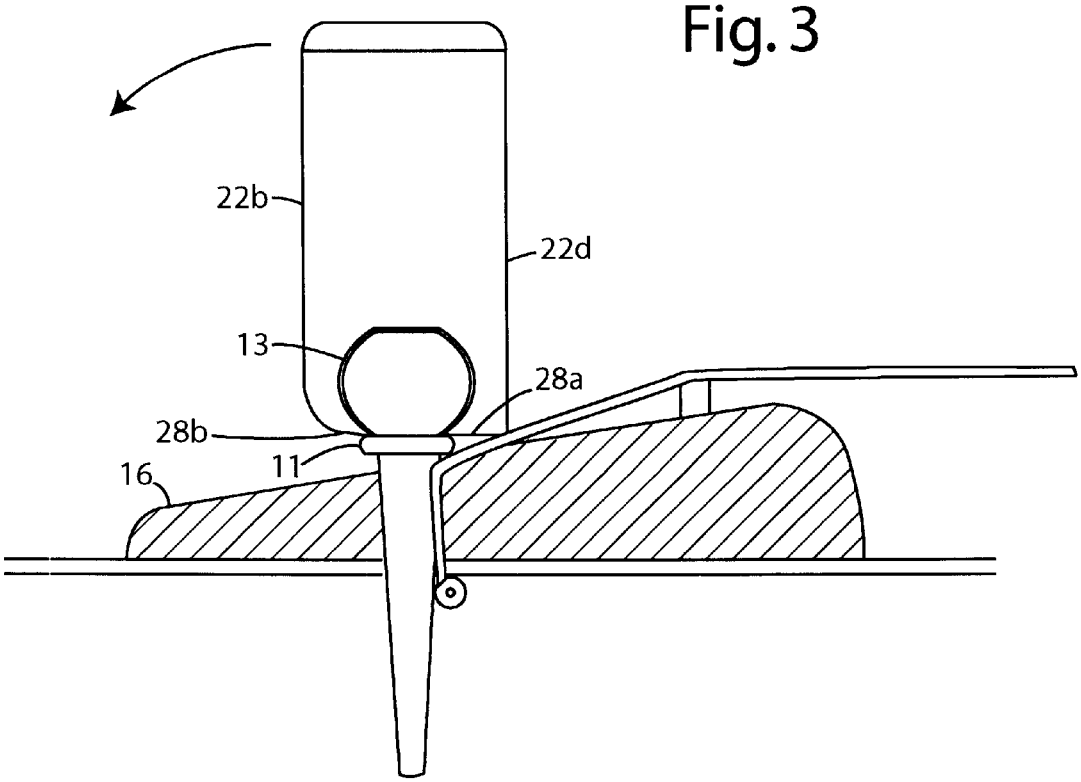
FIG. 3 illustrates the tool according to the invention in use.

The channel 26 is shaped and necked so that it can be slipped sideways from either side face 22*a* and 22*c* over to capture the head of bridge pin 11, as shown in FIG. 3. The bridge pin 11 has a bulbous head 13 which is substantially spherical. The internal profile of the channel is formed in a horseshoe-shape to closely match the cross section of bulbous head 13.

In alternative embodiments, the internal sidewalls of channel 26 can be formed to slightly close in tighter as they progress from one side face 22*c* to 22*a*. Thus the tool will find a point in channel 26 that snugs tightly over the head of the bridge pin 11.

In another embodiment, the channel 26 is of uniform cross section along its length and is relatively short. For example, the length of channel 26 can be reduced to not much more than a single diameter of bulbous head 13.

In order to extract pin 11 from bridge base 16, the two side faces 22*b* and 22*d* are held between a user's finger and thumb. The tool 20 is rotated in the direction of the arrow (FIG. 3) and pulled away from the hole in one movement. Edge 28*b* may be used as a fulcrum, wherein the inner lip of edge 28*a* grips the underside of the bridge pin. The resultant upward force on the pin pulls it loose from from the hole to be lifted away. Due to the good fit between the pin head and the channel of the tool, the pin will generally be retained within the tool, rather than flying off uncontrollably. However, the pin can be easily slid from the tool 20.

FIG. 3 shows the edge 28*b* to be contoured in a way that rounds off the corner at the operative end. This feature improves the feel of the device and allows the tool to be rotated more easily, but it is not essential to the device. Indeed, both sidewalls may be straight, as 28*a*, or both may be curved.

Figure 4:
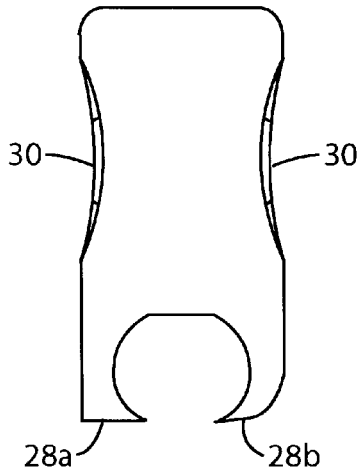
FIG. 4 is a side view of an alternative shaping of the tool according to the invention.

In addition, grooves or curved recesses 30 (FIG. 4) can be provided in the long faces of the tool to give a more ergonomic feel.

In the example shown, the channel 26 extends along the entire length of the end face, from side 22*a* to 22*c*. This has the advantage that the tool can be used on instruments with an elevated ridge behind the bridge pins. Access to the inner bridge pins can be gained by sliding the tool over the heads of the outer bridge pins one by one, until the required pin is reached.

However, in alternative embodiments the channel 26 is blind at one end and does not extend across the full width of the tool. Side face 22*a* or 22*c* may be left intact to define a recess that stops part way along the end face. In this case, the recess is formed to a depth large enough to accommodate the head 13 of the bridge pin 11. The fully intact side face provides additional structural strength.

The tool 20 may be cast, molded, or machined from plastic, metal, wood or other materials. A preferred plastic material is polypropylene, since it can be formed to be very stiff. Typically, such plastic may be 30% glass filled polypropylene, although the exact composition of the plastic can be varied according to the requirements of resilience, cost, and appearance. The tool can be formed by injection molding processes, as are well known in the art.

Wood tools are expensive to manufacture because they are not easily mass produced. But wood has a desirable feel and look, and therefore may be marketed as a luxury item for a keen musician.

A number of modifications can be made to the tool to provide additional functionality. For example, a top face 24*b* may be provided with a pad 32 for cleaning the strings of the instrument.

A second example provides electronic circuitry mounted on the tool for emitting one or more audible frequencies. The circuitry includes a battery, a switch, a signal producing element and a loudspeaker. The signal producing element may be a small chip of the kind used in musical greeting cards, or may be of a more simple type for emitting a signal of a single frequency. Depression of a switch activates the circuitry and causes emission of an audible frequency. This frequency is used as a reference frequency for the musician, so that he/she can tune the instrument. For example, the device may emit a tone at concert E pitch, or concert A. Alternatively, the device may emit a sequence of tones corresponding to the normal open tunings of the strings on the instrument.

By providing the frequency emitter on the same tool, a replaced string or set of strings can quickly be tuned to the correct pitch, without the need for an additional tuning fork or electronic tuner.

In order to accommodate the circuitry for the frequency emitter, the tool may be hollowed out to provide space for the battery, signal emitter and loudspeaker. The switch is provided on the surface of the tool for activating the device, and the loudspeaker is positioned so that emitted sound is clearly heard.

A further modification provides one of the non-operative faces with a ring attachment 34. The ring 34 may be partially embedded in the tool, and provides means for attaching a chain and/or clip, such as those used for key ring attachments. This modification allows the tool to be fixed or clipped to a belt, bag or strap, reducing the likelihood of losing the tool.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A guitar bridge-pin removal tool, comprising:

a solid body sized to fit in a users hand and having opposite surfaces that can be gripped between the thumb and fingers;

a channel disposed across a distal end of the solid body and having longitudinal lips and a main cross section that approximates that of a head of a bridge pin that retains a string in a guitar;

a necked outer edge that runs along the longitudinal lips of the channel and that provide a means for capturing said head of said bridge pin along any portion; and at least one open side end in the channel that allows said head of said bridge pin to be slipped in and out.

2. The tool of claim 1, wherein:

the necked outer edge includes a fulcrum that can be worked to mechanical advantage against a bridge base in said guitar by said user twisting the solid body.

3. The tool of claim 1, wherein:

the channel decreases in its main cross section as it advances across said distal end of the solid body such that it may find a point of tight grip when slipped over said head of said bridge pin.

4. The tool of claim 1, wherein:

the channel has a length not substantially more than a diameter width of a single one of said head of said bridge pin.

5. The tool of claim 1, further comprising:

a ring attached to the solid body and providing for a means to carry or secure the whole for future use.

* * * * *